US009565729B2

(12) United States Patent
Xiao et al.

(10) Patent No.: US 9,565,729 B2
(45) Date of Patent: Feb. 7, 2017

(54) DIMMING DRIVE CIRCUIT AND ILLUMINATION APPARATUS INCLUDING THE DIMMING DRIVE CIRCUIT

(71) Applicant: OSRAM GmbH, Munich (DE)

(72) Inventors: Haibin Xiao, Shenzhen (CN); YuLei Dong, Shenzhen (CN)

(73) Assignee: OSRAM GMBH, Munich (DE)

( * ) Notice: Subject to any disclaimer, the term of this patent is extended or adjusted under 35 U.S.C. 154(b) by 0 days.

(21) Appl. No.: 14/684,464

(22) Filed: Apr. 13, 2015

(65) Prior Publication Data

US 2015/0296583 A1 Oct. 15, 2015

(30) Foreign Application Priority Data

Apr. 14, 2014 (CN) ..... 2014 1 0148825

(51) Int. Cl.
*H05B 39/02* (2006.01)
*H05B 33/08* (2006.01)
*H05B 37/02* (2006.01)

(52) U.S. Cl.
CPC ..... *H05B 33/0845* (2013.01); *H05B 37/02* (2013.01)

(58) Field of Classification Search
CPC ..... H05B 33/0815; H05B 33/0845; H05B 33/0809; H05B 33/0851; H05B 37/02; H05B 33/0848; H05B 33/0818; H05B 33/0824; H05B 33/0887; H05B 33/0803; H05B 33/08; H05B 33/083; H05B 33/0827; H05B 33/084
See application file for complete search history.

(56) References Cited

U.S. PATENT DOCUMENTS

2005/0185353 A1* 8/2005 Rasmussen ..... H02M 1/44 361/93.9
2011/0140622 A1 6/2011 Suzuki
2012/0056553 A1* 3/2012 Koolen ..... H05B 33/0815 315/291

FOREIGN PATENT DOCUMENTS

EP 2590477 A1 5/2013
WO 2014035893 A1 3/2014

OTHER PUBLICATIONS

European Search Report based on application No. 151537792-1802 (6 pages) dated Nov. 3, 2015 (for reference prupose only).

* cited by examiner

*Primary Examiner* — Monica C King
(74) *Attorney, Agent, or Firm* — Viering, Jentschura & Partner mbB

(57) ABSTRACT

Various embodiments may relate to a dimming drive circuit for an illumination apparatus and an illumination apparatus including the dimming drive circuit, wherein the dimming drive circuit includes a filter circuit unit and a bleeder circuit unit, a main control module connected to the filter circuit unit and the bleeder circuit unit, respectively, and an auxiliary control module configured to reduce the current of the bleeder circuit unit and/or to switch off the bleeder circuit unit according to a characteristic input current of the dimming drive circuit prior to switch-off of the bleeder circuit unit by the main control module in a first operation state of the dimming drive circuit, and to prevent the filter circuit unit from releasing electrical energy via the bleeder circuit unit in a second operation state of the dimming drive circuit.

13 Claims, 2 Drawing Sheets

DIMMING DRIVE CIRCUIT AND ILLUMINATION APPARATUS INCLUDING THE DIMMING DRIVE CIRCUIT

CROSS-REFERENCE TO RELATED APPLICATION

This application claims priority to Chinese Patent Application Serial No. 201410148825.8, which was filed Apr. 14, 2014, and is incorporated herein by reference in its entirety.

TECHNICAL FIELD

Various embodiments relate generally to a dimming drive circuit for an illumination apparatus and an illumination apparatus including the dimming drive circuit.

BACKGROUND

In the existing drive devices of an illumination apparatus, the dimming control is usually performed for the illumination apparatus with a phase cut dimming method. The illumination apparatus, for which the dimming is controlled according to the phase cut dimming method, not only can effectively and quickly control the luminous brightness of the illumination apparatus and save the electrical energy to a certain extent, but also has a low cost due to the simple structure and manufacture of the drive device having the phase cut dimming function. The drive device having the phase cut dimming function not only has a high power factor, but also is compatible with a leading phase cut dimming circuit or a trailing phase cut dimming circuit. Besides, this drive device also can operate in a quick response (QR) mode, or operate in a boost-buck mode or in flyback mode. However, the existing drive devices having the phase cut dimming function will increase the power consumption of a bleeder circuit due to connection to a dimmer, and thereby increase the power consumption of the entire integrated circuit to bring about unnecessary power loss to the illumination apparatus.

SUMMARY

Various embodiments relate to a dimming drive circuit for an illumination apparatus and an illumination apparatus including the dimming drive circuit, wherein the dimming drive circuit includes a filter circuit unit and a bleeder circuit unit, a main control module connected to the filter circuit unit and the bleeder circuit unit, respectively, and an auxiliary control module configured to reduce the current of the bleeder circuit unit and/or to switch off the bleeder circuit unit according to a characteristic input current of the dimming drive circuit prior to switch-off of the bleeder circuit unit by the main control module in a first operation state of the dimming drive circuit, and to prevent the filter circuit unit from releasing electrical energy via the bleeder circuit unit in a second operation state of the dimming drive circuit.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

Figure 1:
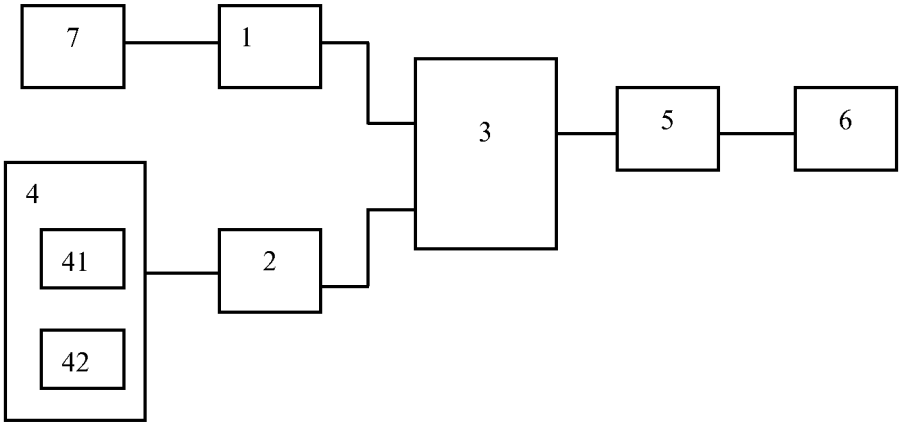
FIG. 1 shows a schematic diagram of a functional block of a dimming drive circuit according to various embodiments.

The following detailed description refers to the accompanying drawings that show, by way of illustration, specific details and embodiments in which the invention may be practiced.

Various embodiments provide a novel dimming drive circuit used for an illumination apparatus. The novel dimming drive circuit for an illumination apparatus according to various embodiments may control the bleeder circuit according to an operation state of the dimming drive circuit, specifically, when an input inrush current is detected to reach a certain value, the bleeder circuit is switched off very quickly so as to reduce unnecessary energy loss of the dimming drive circuit caused by the bleeder circuit, which improves the efficiency of the illumination apparatus in dimming, decreases the heat generation, and improves the reliability and the service lifetime of the illumination apparatus. Furthermore, the dimming drive circuit according to various embodiments has a simple circuit structure, a low cost, and good reliability, and is easy to manufacture.

Various embodiments provide a dimming drive circuit for an illumination apparatus that includes a filter circuit unit and a bleeder circuit unit, and a main control module connected to the filter circuit unit and the bleeder circuit unit, respectively, wherein the dimming drive circuit further includes an auxiliary control module configured to reduce the current of the bleeder circuit unit and/or to switch off the bleeder circuit unit according to a characteristic input current of the dimming drive circuit prior to switch-off of the bleeder circuit unit by the main control module in a first operation state of the dimming drive circuit, and to prevent the filter circuit unit from releasing electrical energy via the bleeder circuit unit in a second operation state of the dimming drive circuit. According to various embodiments, the auxiliary control module may reduce for instance delay of switch-off of the bleeder circuit caused by the main control module so as to reduce the electrical energy consumed by the bleeder circuit when the dimming device of the illumination apparatus is switched off, and also to avoid the loss of the stored electrical energy directly released via the bleeder circuit when the dimming device is in operation.

According to various embodiments, the auxiliary control module includes a first control unit and a second control unit, wherein the first control unit reduces a current of the bleeder circuit unit and/or switches off the bleeder circuit unit according to the characteristic input current of the dimming drive circuit prior to switch-off of the bleeder circuit unit by the main control module in the first operation state, and the second control unit prevents the filter circuit unit from releasing electrical energy by the bleeder circuit unit in the second operation state. The first control unit and the second control unit can respectively reduce unnecessary electrical energy loss caused by the bleeder circuit in different operation states of the dimming drive circuit.

In various embodiments, the characteristic input current is an inrush current. In a situation such as leading phase dimming, when the circuit is conducted so that an input voltage of the dimming drive circuit rises, an inrush current in a relatively big amplitude will suddenly flow into the circuit. The dimming drive circuit according to various embodiments may directly reduce the current of the bleeder circuit or directly switch off the bleeder circuit with the help of the inrush current when the inrush current rushes into the circuit in a situation of leading dimming, so as to reduce the electrical energy loss caused by the bleeder circuit. Switch-off of the bleeder circuit according to the inrush current occurs before the main control module attempting to switch off the bleeder circuit, which thereby reduces the electrical energy loss when the main control module attempts to switch off the bleeder circuit.

According to various embodiments, the first operation state is an operation state where the dimming drive circuit operates in leading phase dimming, and the second operation state is an operation state where the dimming drive circuit operates in trailing phase dimming. According to this design, when for instance the illumination apparatus operates in the leading phase dimming, i.e., leading chopping dimming, the dimming drive circuit may control the current of the bleeder circuit according to the inrush current; and when for instance the illumination apparatus operates in the trailing phase dimming, i.e., trailing chopping dimming, the dimming drive circuit may prevent the electrical energy, in the circuit for instance stored in capacitors, from being directly released via the bleeder circuit.

In various embodiments, the first control unit is configured to reduce the drive voltage input to a switch unit of the bleeder circuit unit according to the characteristic input current. By controlling the drive voltage of the switch unit, the current of the bleeder circuit may be reduced and the current is eventually reduced to switch off the bleeder circuit, or the bleeder circuit can be directly switched off.

According to various embodiments, the dimming drive circuit further includes a power conversion module connected between the main control module and an output module of the dimming drive circuit, and the power conversion module is capable of converting and outputting electrical energy from the filter circuit unit which is not released by the bleeder circuit unit to the output module in the second operation state. The power conversion module is capable of converting and transmitting the electrical energy, which is in the circuit for instance stored in capacitors and should have been directly released by the bleeder circuit, to a load of the illumination apparatus so as to reduce the consumption of the electrical energy and improve the usage efficiency of the electrical energy.

In various embodiments, the first control unit includes a first diode and a first resistor, the cathode of the first diode and one end of the first resistor are respectively connected a control terminal of a switch unit of the bleeder circuit unit, and the anode of the first diode is connected to an input module of the dimming drive circuit, and the other end of the first resistor is connected to the main control module. The first diode and the first resistor may effectively and simply reduce the drive voltage of the control terminal of the switch unit so as to reduce the current of the bleeder circuit.

In various embodiments, the second control unit includes a second diode with its anode being connected to the bleeder circuit unit and its cathode being connected to the filter circuit unit. The second diode may prevent the electrical energy, in the filter circuit stored in capacitors, from being directly released via the bleeder circuit.

In various embodiments, the bleeder circuit unit includes a transistor as the switch unit, and a second resistor and a third resistor, wherein the cathode of the first diode and the first resistor are respectively connected to the control electrode of the transistor, the second resistor is connected to the operating electrode of the transistor, and the reference electrode of the transistor is grounded via the third resistor. The transistor, the second resistor, and the third resistor form a current-limiting load, and the transistor may be switched off in compliance with the auxiliary control module.

Various embodiments further provide an illumination apparatus that includes the above dimming drive circuit and a load connected to an output module of the dimming drive circuit. The illumination apparatus according to various embodiments may effectively reduce unnecessary electrical energy loss caused by the bleeder circuit.

In various embodiments, the load is configured as LED. An LED illumination apparatus has the advantages such as highly effectively illumination effect and low power consumption.

FIG. 1 shows a schematic diagram of a functional block of a dimming drive circuit 100 according to various embodiments. As shown in FIG. 1, the dimming drive circuit 100 according various embodiments includes a main control module 3, and a filter circuit unit 1 and a bleeder circuit unit 2 which are connected to the main control module 3. The main control module 3 may be configured as an integrated circuit or a central controller integrated with a leading chopping dimmer and a trailing chopping dimmer, wherein the leading chopping dimmer has a leading phase dimming function and the trailing chopping dimmer has a trailing phase dimming function. Besides, the dimming drive circuit 100 further includes a power conversion unit 5 connected to the main control module 3, an input module 7 connected to the filter circuit unit 1, an output module 6 connected to the power conversion module 5, and an auxiliary control module 4 connected to the bleeder circuit unit 2. The dimming drive circuit 100 is connected to a load of the illumination apparatus via the output module 6, wherein the load can be configured as for instance an LED lamp. According to various embodiments, the auxiliary control module 4 is configured to include control subunits, i.e., a first control unit 41 and a second control unit 42. The first control unit 41 may control the bleeder circuit unit 2 according to the inrush current when the dimming drive circuit 100 operates in a leading phase dimming state, and the second control unit 42 prevents the filter circuit unit 1 from releasing the electrical energy by the bleeder circuit unit 2 when the dimming drive unit 100 operates in a trailing phase dimming state.

The dimming drive circuit 100 according to various embodiments may decrease the power consumption in the leading phase dimming state by quickly reducing the current of the bleeder circuit unit 2 and/or completely switching off the bleeder circuit unit 2, prior to that the main control module 3 switches off the bleeder circuit unit 2, and may reduce the loss of electrical energy in a transitional process when the dimmer is switched off in a trailing phase dimming state by preventing the filter circuit unit in the trailing phase dimming state from releasing the electrical energy via the bleeder circuit unit. Hereinafter, the circuit structure of the dimming drive circuit 100 according to various embodiments will be described in detail in FIG. 2.

Figure 2:
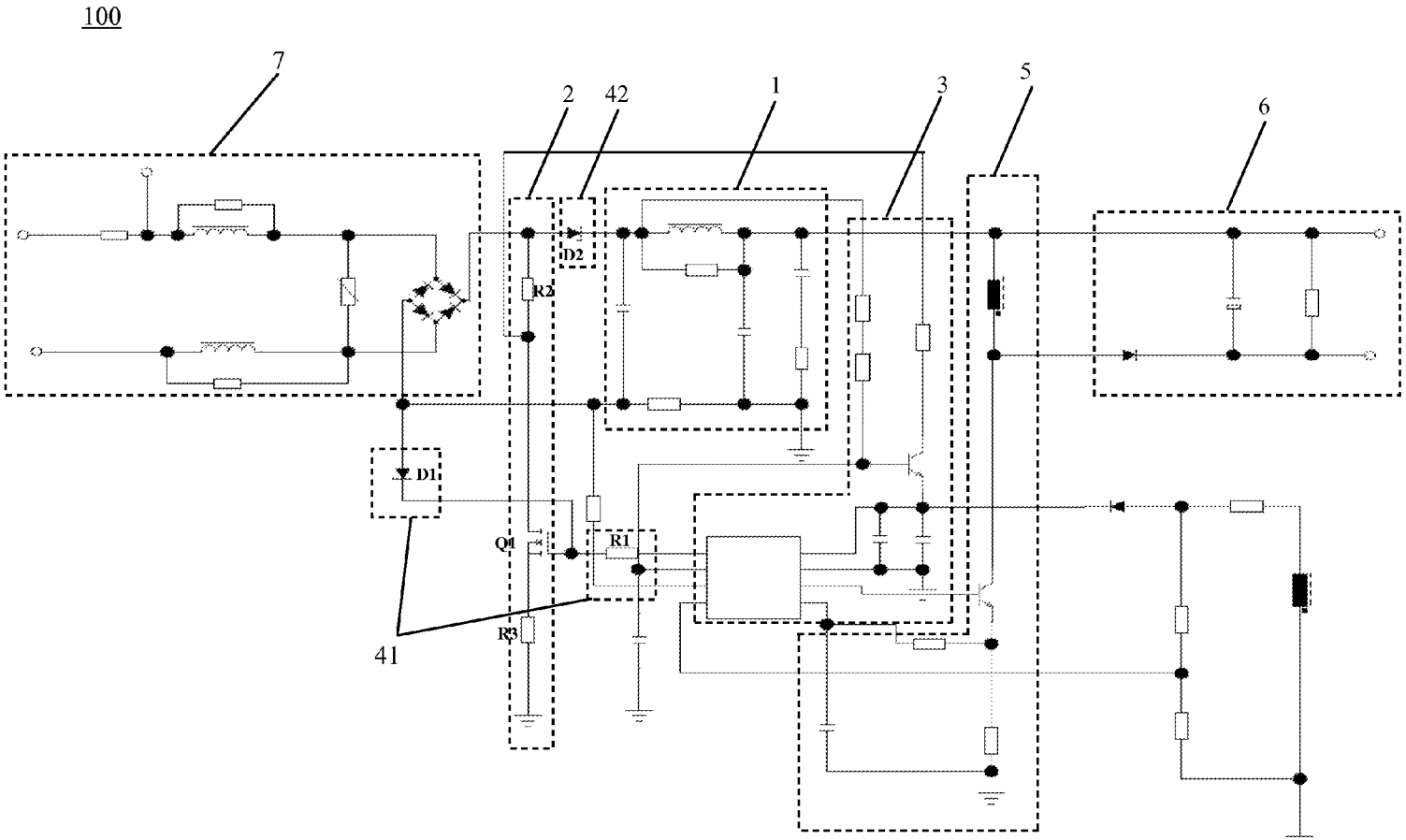
FIG. 2 shows a schematic diagram of a circuit structure of the dimming drive circuit according to various embodiments.

As shown in FIG. 2, FIG. 2 shows a schematic diagram of the circuit structure of the dimming drive circuit 100 according to various embodiments. The bleeder circuit unit 2 includes a transistor Q1 as a switch unit, the transistor Q1 herein is for instance configured as MOSFET, and the transistor Q1 also may be configured as a typical bipolar transistor according to specific application requirements. The bleeder circuit unit 2 also includes a third resistor R3 connected to the source electrode of the transistor Q1 and a second resistor R2 connected to the drain electrode of the transistor Q1, and the source electrode of the transistor Q1 is grounded via the third resistor R3. The first control unit 41 includes a first diode D1 with its cathode being connected to the gate electrode of the transistor Q1 and a first resistor R1 with one end also being connected to the gate electrode of the transistor Q1.

When the dimming drive circuit 100 operates in a first operation state, i.e., a leading phase dimming state, since an input voltage from the input module 7 rises, an instantly quite large inrush current is present and flows into the circuit, and wherein the inrush current becomes higher as its conduction angle approaches 90°. At which time, the input voltage has been elevated, the bleeder circuit unit 2 should be immediately switched off by the main control module 3 in an ideal situation, to reduce the loss, but the process from that the dimmer is conducted to that the main control module 3 detects the conduction of the dimmer and then thereby switches off the transistor Q1 of the bleeder circuit unit 2 results in, to a certain extent, delay of switch-off of the transistor Q1 by the main control module 3, and causes increase of unnecessary loss of the bleeder circuit unit 2. However, the dimming drive circuit according to various embodiments may use the inrush current appearing after the dimmer is conducted to produce a negative voltage (relative to the ground) on the first resistor R1 of the first control unit 41, which negative voltage pulls down the drive voltage of the transistor Q1 via the first diode D1, consequently, the higher the inrush current is, the lower the drive voltage of the transistor Q1 is, thereby the current of the current-limiting load formed by the transistor Q1, the second resistor R2, and the third resistor R3 is reduced, that is, the current and the loss of the bleeder circuit unit 2 are reduced. At this time, if the inrush current is sufficiently large and the drive voltage of the transistor Q1 is reduced below a threshold voltage, the bleeder current of the bleeder circuit unit 2 will be cut off completely such that the loss caused by the bleeder circuit unit 2 will not occur. Besides, the input power consumption in the leading phase dimming state may be effectively reduced by appropriately selecting a Zener voltage of the first diode D1 and a resistance value of the first resistor R1.

The second control unit 42 includes a second diode D2 which has its anode connected to the bleeder circuit unit 2 and its cathode connected to a filter circuit unit 1. When the dimming drive circuit 100 operates in a second operation state, i.e., trailing phase dimming state or trailing chopping dimming state, when the trailing chopping dimmer is switched off, since the circuit, especially the capacitors in the filter circuit unit 1, store electrical energy, capacitors of the dimmer and capacitors of the filter circuit unit 1 still have high voltage. At this time, in an ideal situation, when the dimmer is switched off, it only needs that the bleeder circuit unit bleeds off the voltage of the capacitors of the dimmer to reset the dimmer, but the voltage of the capacitor of the filter circuit unit 1 does not need to be bled off, and the voltage of the capacitors can be converted by the power conversion module 5 and transmitted to the load of the illumination apparatus to achieve effective usage. According to various embodiments, the second diode D2 may prevent bleed-off of the electrical energy of the capacitor of the filter circuit unit 1 via the bleeder circuit unit 2, so as to reduce the loss of the dimming drive circuit 100 caused by the bleeder circuit unit 2 in the trailing phase dimming state.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A dimming drive circuit for an illumination apparatus, comprising;

a filter circuit unit and a bleeder circuit unit, a main control module connected to the filter circuit unit and the bleeder circuit unit, respectively, and an auxiliary control module configured to reduce the current of the bleeder circuit unit and/or to switch off the bleeder circuit unit according to a characteristic input current of the dimming drive circuit prior to switch-off of the bleeder circuit unit by the main control module in a first operation state of the dimming drive circuit, and to prevent the filter circuit unit from releasing electrical energy via the bleeder circuit unit in a second operation state of the dimming drive circuit.

2. The dimming drive circuit according to claim 1, wherein the auxiliary control module comprises a first control unit and a second control unit, wherein the first control unit reduces the current of the bleeder circuit unit and/or switches off the bleeder circuit unit according to the characteristic input current of the dimming drive circuit prior to switch-off of the bleeder circuit unit by the main control module in the first operation state, and the second control unit prevents the filter circuit unit from releasing electrical energy via the bleeder circuit unit in the second operation state.

3. The dimming drive circuit according to claim 1, wherein the characteristic input current is an inrush current.

4. The dimming drive circuit according to claim 1, wherein the first operation state is an operation state where the dimming drive circuit operates in leading phase dimming, and the second operation state is an operation state where the dimming drive circuit operates in trailing phase dimming.

5. The dimming drive circuit according to claim 2, wherein the first control unit is configured to reduce the drive voltage input to a switch unit of the bleeder circuit unit according to the characteristic input current.

6. The dimming drive circuit according to claim 1, further comprising:

a power conversion module connected between the main control module and an output module of the dimming drive circuit, wherein the power conversion module is capable of converting and outputting electrical energy from the filter circuit unit which is not released by the bleeder circuit unit to the output module in the second operation state.

7. The dimming drive circuit according to claim 2, wherein the first control unit comprises a first diode and a first resistor, the cathode of the first diode and one end of the first resistor are respectively connected a control terminal of a switch unit of the bleeder circuit unit, and the anode of the first diode is connected to an input module of the dimming drive circuit, and the other end of the first resistor is connected to the main control module.

8. The dimming drive circuit according to claim 7, wherein the second control unit comprises a second diode with its anode being connected to the bleeder circuit unit and its cathode being connected to the filter circuit unit.

9. The dimming drive circuit according to claim 7, wherein the bleeder circuit unit comprises a transistor as the switch unit, and a second resistor and a third resistor, wherein the cathode of the first diode and the first resistor are respectively connected to the control electrode of the transistor, the second resistor is connected to the operating electrode of the transistor, and the reference electrode of the transistor is grounded via the third resistor.

10. An illumination apparatus, comprising:

a dimming drive circuit, the dimming drive circuit comprising:

a filter circuit unit and a bleeder circuit unit, a main control module connected to the filter circuit unit and the bleeder circuit unit, respectively, and an auxiliary control module configured to reduce the current of the bleeder circuit unit and/or to switch off the bleeder circuit unit according to a characteristic input current of the dimming drive circuit prior to switch-off of the bleeder circuit unit by the main control module in a first operation state of the dimming drive circuit, and to prevent the filter circuit unit from releasing electrical energy via the bleeder circuit unit in a second operation state of the dimming drive circuit, and a load connected to an output module of the dimming drive circuit.

11. The illumination apparatus according to claim 10, wherein the load is configured as LED.

12. The dimming drive circuit according to claim 1, wherein the auxiliary control module further comprises a first control unit and a second control unit;

wherein the first control unit further comprises a diode;

wherein the diode further comprises a cathode that is connected to a gate electrode of a transistor, and wherein the transistor regulates the flow of electrical energy in the bleeder circuit.

13. The dimming drive circuit according to claim 1, wherein the auxiliary control module further comprises a diode and a resistor;

wherein an inrush current causes the diode and resistor to pull down the drive voltage of a transistor; and wherein the pulling down of the drive voltage of the transistor regulates the flow of electrical energy in the bleeder circuit.

* * * * *